US008061260B2

(12) United States Patent
Kenney et al.

(10) Patent No.: US 8,061,260 B2
(45) Date of Patent: Nov. 22, 2011

(54) GAS PLUG RETENTION AND REMOVAL DEVICE

(75) Inventors: Daniel E. Kenney, Elizabethtown, KY (US); James W. Ronkainen, Hodgenville, KY (US); David O. Matteson, Horse Cave, KY (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 12/820,930

(22) Filed: Jun. 22, 2010

(65) Prior Publication Data

US 2010/0319528 A1 Dec. 23, 2010

Related U.S. Application Data

(63) Continuation-in-part of application No. 29/364,276, filed on Jun. 21, 2010.

(60) Provisional application No. 61/219,007, filed on Jun. 22, 2009.

(51) Int. Cl.
*F41A 5/28* (2006.01)

(52) U.S. Cl. ..... 89/193

(58) Field of Classification Search ..... 89/191.01, 89/193

See application file for complete search history.

(56) References Cited

U.S. PATENT DOCUMENTS 960,825 A * 6/1910 Colleoni ..... 89/126
1,388,879 A * 8/1921 Nelson ..... 89/193
1,996,124 A 4/1935 Rowley
2,093,706 A 9/1937 Browning
2,186,582 A 1/1940 Gebauer
2,456,290 A 12/1948 Ljutic
2,554,618 A 5/1951 Dixon
2,637,247 A 5/1953 Hester
2,887,013 A 5/1959 Marsh
2,918,847 A 12/1959 Barr (Continued)

FOREIGN PATENT DOCUMENTS

CH 250094 4/1946

(Continued)

OTHER PUBLICATIONS

International Search Report for related PCT application No. PCT/US2010/039538, mailed Sep. 7, 2010.

(Continued)

*Primary Examiner* — Stephen M Johnson
(74) *Attorney, Agent, or Firm* — McGuireWoods, LLP

(57) ABSTRACT

A gas plug retention and removal device for a gas operating system of a firearm. The gas operating system can include a gas block comprising a front end, a rear end, a gas block bore defined between the front and rear ends, and at least one cam engagement surface. A gas plug can be removably received in the front end of the gas block for at least partially sealing the gas block bore, and a cam lever bail can be pivotally coupled to the gas plug and include at least one lever arm. The at least one lever arm can be pivotally connected to the gas plug, be adapted to engage the gas block, and have at least one cam lobe formed therealong. The at least one cam lobe can engage the cam engagement surface of the gas block as the cam lever bail is pivoted so as to disengage and facilitate the removal of the gas plug from the gas block to provide access to the gas block bore.

27 Claims, 9 Drawing Sheets

U.S. PATENT DOCUMENTS

| | | | | |
|---|---|---|---|---|
| 2,918,848 | A | | 12/1959 | Maillard |
| 2,983,196 | A | | 5/1961 | Dixon |
| 2,987,968 | A | | 6/1961 | Janson |
| 3,166,983 | A | | 1/1965 | Lizza |
| 3,207,036 | A | | 9/1965 | Norton |
| 3,306,168 | A | | 2/1967 | Blumrick |
| 3,330,183 | A | * | 7/1967 | Loffler ..... 89/193 |
| 3,443,477 | A | | 5/1969 | Kaempf |
| 3,444,641 | A | | 5/1969 | Ruger |
| 3,592,101 | A | | 7/1971 | Vartanian et al. |
| 3,680,434 | A | | 8/1972 | Muhlemann |
| 3,690,219 | A | | 9/1972 | Muhlemann et al. |
| 3,707,110 | A | | 12/1972 | Alday |
| 3,709,092 | A | | 1/1973 | Tazome |
| 3,776,096 | A | | 12/1973 | Donovan |
| 3,810,412 | A | | 5/1974 | Zamacola |
| 3,945,296 | A | | 3/1976 | Hyytinen |
| 3,988,964 | A | | 11/1976 | Moore |
| 3,990,348 | A | | 11/1976 | Vesamaa |
| 3,999,534 | A | | 12/1976 | Chapin et al. |
| 4,014,247 | A | | 3/1977 | Tollinger |
| 4,015,512 | A | | 4/1977 | Feerick |
| 4,058,922 | A | | 11/1977 | Elbe et al. |
| 4,085,654 | A | | 4/1978 | Panigoni |
| 4,102,242 | A | | 7/1978 | Liedke |
| 4,102,243 | A | | 7/1978 | Jennie |
| 4,109,558 | A | | 8/1978 | Panigoni |
| 4,125,054 | A | | 11/1978 | Jennie |
| 4,126,077 | A | | 11/1978 | Quesnel |
| 4,324,170 | A | | 4/1982 | Healy |
| 4,373,423 | A | | 2/1983 | Moore |
| 4,389,920 | A | | 6/1983 | Dufour, Sr. |
| 4,395,838 | A | | 8/1983 | Civolani |
| 4,395,938 | A | | 8/1983 | Curtis |
| 4,409,883 | A | | 10/1983 | Nyst |
| 4,414,880 | A | | 11/1983 | Throner et al. |
| 4,475,438 | A | | 10/1984 | Sullivan |
| 4,505,183 | A | | 3/1985 | Grehl |
| 4,538,502 | A | | 9/1985 | Benelli |
| 4,563,937 | A | | 1/1986 | White |
| 4,599,934 | A | | 7/1986 | Palmer |
| 4,604,942 | A | | 8/1986 | Benelli |
| 4,702,146 | A | | 10/1987 | Ikeda et al. |
| 4,709,617 | A | | 12/1987 | Anderson |
| 4,765,224 | A | | 8/1988 | Morris |
| 4,872,392 | A | | 10/1989 | Powers et al. |
| 4,901,623 | A | | 2/1990 | Lee |
| 5,173,564 | A | | 12/1992 | Hammond, Jr. |
| 5,218,163 | A | | 6/1993 | Dabrowski |
| 5,272,956 | A | | 12/1993 | Hudson |
| 5,274,939 | A | | 1/1994 | Scaramucci et al. |
| 5,276,988 | A | | 1/1994 | Swan |
| 5,279,202 | A | | 1/1994 | Bellardi et al. |
| 5,287,642 | A | | 2/1994 | Scaramucci |
| 5,351,598 | A | | 10/1994 | Schuetz |
| 5,404,790 | A | | 4/1995 | Averbukh |
| 5,448,940 | A | | 9/1995 | Schuetz et al. |
| 5,499,569 | A | | 3/1996 | Schuetz |
| 5,520,019 | A | | 5/1996 | Schuetz |
| 5,726,377 | A | | 3/1998 | Harris et al. |
| 5,737,865 | A | | 4/1998 | Brandl et al. |
| 5,767,434 | A | | 6/1998 | Hirtl et al. |
| 5,824,943 | A | | 10/1998 | Guhring et al. |
| 5,827,992 | A | | 10/1998 | Harris et al. |
| 5,872,323 | A | | 2/1999 | Norton et al. |
| 5,937,558 | A | | 8/1999 | Gerard |
| 5,939,659 | A | | 8/1999 | Dobbins |
| 5,959,234 | A | | 9/1999 | Scaramucci |
| 5,983,549 | A | | 11/1999 | Battaglia |
| 6,029,645 | A | | 2/2000 | Wonisch et al. |
| 6,243,978 | B1 | | 6/2001 | Vignaroli et al. |
| 6,374,528 | B1 | | 4/2002 | Davis et al. |
| 6,374,720 | B1 | | 4/2002 | Tedde |
| 6,382,073 | B1 | | 5/2002 | Beretta |
| 6,442,883 | B1 | | 9/2002 | Waterman et al. |
| 6,508,160 | B2 | | 1/2003 | Beretta |
| 6,604,311 | B1 | | 8/2003 | Laney et al. |
| 6,619,592 | B2 | | 9/2003 | Vignaroli et al. |
| 6,662,485 | B2 | | 12/2003 | Kay |
| 6,772,548 | B1 | | 8/2004 | Power |
| 6,834,455 | B2 | | 12/2004 | Burigana |
| 6,848,351 | B1 | | 2/2005 | Davies |
| 6,886,286 | B2 | | 5/2005 | Dowding |
| 6,889,461 | B2 | | 5/2005 | Vignaroli et al. |
| 6,907,814 | B2 | | 6/2005 | Spinner et al. |
| 6,971,202 | B2 | | 12/2005 | Bender |
| 7,107,715 | B2 | | 9/2006 | Keeney et al. |
| 7,162,822 | B1 | | 1/2007 | Heayn et al. |
| 7,162,823 | B2 | | 1/2007 | Schoppman et al. |
| 7,252,138 | B2 | | 8/2007 | Burkhalter et al. |
| 7,311,032 | B2 | | 12/2007 | Murello |
| 7,343,844 | B2 | | 3/2008 | Poff, Jr. |
| 7,418,898 | B1 | | 9/2008 | Desomma |
| 7,448,307 | B1 | | 11/2008 | Dafinov |
| 7,461,581 | B2 | | 12/2008 | Leitner-Wise |
| 7,467,581 | B2 | | 12/2008 | Botty |
| 7,469,624 | B1 | | 12/2008 | Adams |
| 2001/0054350 | A1 | | 12/2001 | Beretta |
| 2002/0073832 | A1 | | 6/2002 | Vignaroli et al. |
| 2002/0096042 | A1 | | 7/2002 | Adkins |
| 2002/0139362 | A1 | | 10/2002 | Shipachev et al. |
| 2005/0016374 | A1 | | 1/2005 | Pescini |
| 2005/0115398 | A1 | | 6/2005 | Olson |
| 2005/0223613 | A1 | | 10/2005 | Bender |
| 2005/0235817 | A1 | | 10/2005 | Murello |
| 2005/0257681 | A1 | | 11/2005 | Kenney et al. |
| 2005/0268516 | A1 | | 12/2005 | Nelson |
| 2006/0026883 | A1 | | 2/2006 | Hochstrate et al. |
| 2006/0065112 | A1 | | 3/2006 | Kuczynko et al. |
| 2007/0012169 | A1 | | 1/2007 | Gussalli |
| 2007/0199435 | A1 | | 8/2007 | Hochstrate et al. |
| 2008/0276797 | A1 | | 11/2008 | Leitner-Wise |
| 2008/0307954 | A1 | | 12/2008 | Fluhr et al. |
| 2009/0223357 | A1 | | 9/2009 | Herring |

FOREIGN PATENT DOCUMENTS

| | | | |
|---|---|---|---|
| DE | 41 36 665 | A1 | 5/1993 |
| EP | 0 288 244 | A | 10/1988 |
| EP | 1 215 464 | | 6/2002 |
| EP | 1 624 275 | | 2/2006 |
| FR | 2 686 152 | | 7/1993 |
| GB | 214505 | A | 4/1924 |
| GB | 525429 | | 8/1940 |
| GB | 2 089 949 | A | 6/1982 |
| RU | 2279028 | C1 | 6/2006 |
| WO | WO 03/076863 | A1 | 9/2003 |
| WO | WO 2007/122626 | | 11/2007 |
| WO | WO-2009/061546 | | 5/2009 |
| WO | WO-2008/108786 | | 9/2009 |

OTHER PUBLICATIONS

Written Opinion for related PCT application No. PCT/US2010/039538, mailed Sep. 7, 2010.

DS Arms, Inc.; "Austrian Gas Plug Release Lever Kit with Washer"; http://www.dsarms.com/austrian-gas-plug-release-lever-kit-with-washer—009B/productinfo/009B/.

Alpharubicon.com; "FAL/L1A1"; http ://www.alpharubicon.com/leo/fal.htm.

Alpharubicon.com; "Fieldstripping and Cleaning the FAL Variant"; http://www.alpharubicon.com/leo/falstripping.htm.

MilitaryMorons.com; "Primary Weapon Systems AR15 Piston Conversion"; http://www.militarymorons.com/weapons/ar.uppers2.html.

Dynamic Armament Inc.; "POF USA Piston Rifle System 16" Fluted Barrel; http://dynamicarmament.com/items/ar-15-ar-10-rifles/pof-usa-rifles/pof-usa-p-9x-piston-rifle-system-16-fluted-barrel-pof-usa-p-9x-rifle-detail.htm.

Big Sky Guns LLC; "DPMS LR308, 24" Stainless Steel Fluted Barrel—308 Win Rifles by . . . ; http://www.bigskyguns.com/308-Win_Rifles-DPMS_LR308_24_Stainless_Steel_Fluted_Barrel.htm.

International Search Report for Application No. PCT/IL2007/000515, mailed Sep. 28, 2007.
Written Opinion for Application No. PCT/IL2007/000515, mailed Sep. 28, 2007.
International Search Report for Application No. PCT/US2007/012364, mailed Oct. 27, 2003.
Written Opinion for Application No. PCT/US2007/012364, mailed Oct. 27, 2003.
International Search Report for Application No. PCT/US2008/074601, mailed Jul. 21, 2009.
Written Opinion for Application No. PCT/US2008/074601, mailed Jul. 21, 2009.
Notification of Transmittal of the International Preliminary Report on Patentability for Application No. PCT/US2010/039526, mailed Sep. 14, 2011.

* cited by examiner

GAS PLUG RETENTION AND REMOVAL DEVICE

CROSS-REFERENCE TO RELATED APPLICATIONS

This application claims the benefit of U.S. Provisional Patent Application No. 61/219,007, filed Jun. 22, 2009. This application is a Continuation-in-Part of United States Design patent application Ser. No. 29/364,276, filed Jun. 21, 2010.

INCORPORATION BY REFERENCE

Each of U.S. Provisional Patent Application No. 61/219,007, which was filed Jun. 22, 2009, and United States Design patent application Ser. No. 29/364,276, which was filed on Jun. 21, 2010, is hereby incorporated by reference for all purposes as if presented herein in its entirety.

TECHNICAL FIELD

Embodiments of the disclosure are directed generally to gas operated firearms and, more particularly, to a gas plug retention and removal device for a gas-operated firearm.

BACKGROUND INFORMATION

Semi-automatic firearms, such as rifles and shotguns, are designed to fire a round of ammunition, such as a cartridge or shot shell, in response to each squeeze of the trigger of the firearm, and thereafter automatically load the next shell or cartridge from the firearm magazine into the chamber of the firearm. During firing, the primer of the round of ammunition ignites the propellant inside the round, producing an expanding column of high pressure gases within the chamber and barrel of the firearm. The force of this expanding gas propels the bullet/shot of the cartridge or shell down the barrel.

In semi-automatic rifles and shotguns, a portion of the expanding gases typically are directed through a duct or port that interconnects the barrel of the firearm to a piston assembly that generally houses an axially moveable gas piston. This piston assembly further typically includes a gas block that connects the piston assembly to the barrel, and through which the explosive gases pass. In some systems, the gas blocks are one piece elements located on their firearms and aligned with the port in the barrel through which the gases from the fired cartridge flow into the gas block and back to the action for expelling the spent cartridge and for chambering a fresh cartridge. The portion of the explosive gases that are diverted from the barrel of the firearm act upon the gas piston so as to force the gas piston in a rearward direction to cause the rearward motion of the bolt of the firearm. This rearward motion of the bolt opens the chamber, ejects the empty shell or cartridge casing, and thereafter loads another shell or cartridge into the chamber, after which the bolt returns to a locked position for firing as the gases dissipate or are bled off.

SUMMARY OF THE DISCLOSURE

Briefly described, in one embodiment of the invention, a gas plug retention and removal device is provided for use with a gas-operated firearm. The gas operating system can comprise a gas block with a front end, a rear end, a gas block bore defined between the front and rear ends, and at least one cam engagement surface formed along the length of the gas block adjacent its front end. The gas plug retention and removal device generally will include a gas plug that can be removably received in the front end of the gas block for at least partially sealing the gas block bore at the front end of the gas block, and a cam lever bail pivotally coupled to the gas plug and including at least one lever arm. The at least one lever arm further can be pivotally connected to the gas plug and can have at least one cam lobe formed therealong. The cam lever bail typically is adapted to engage the gas block and can fit in a substantially flat-lying alignment with respect to the gas block so as to minimize the profile or size of the gas plug retention and removal device when in a non-operative position. The at least one cam lobe of the lever arm can engage the cam engagement surface of the gas block as the cam lever bail is pivoted so as to facilitate the disengagement and removal of the gas plug from the gas block bore and gas block to provide external access to the gas block bore.

These and various other advantages, features, and aspects of the exemplary embodiments will become apparent and more readily appreciated from the following detailed description of the embodiments taken in conjunction with the accompanying drawings, as follows.

DETAILED DESCRIPTION OF THE EXEMPLARY EMBODIMENTS

Figure 1:
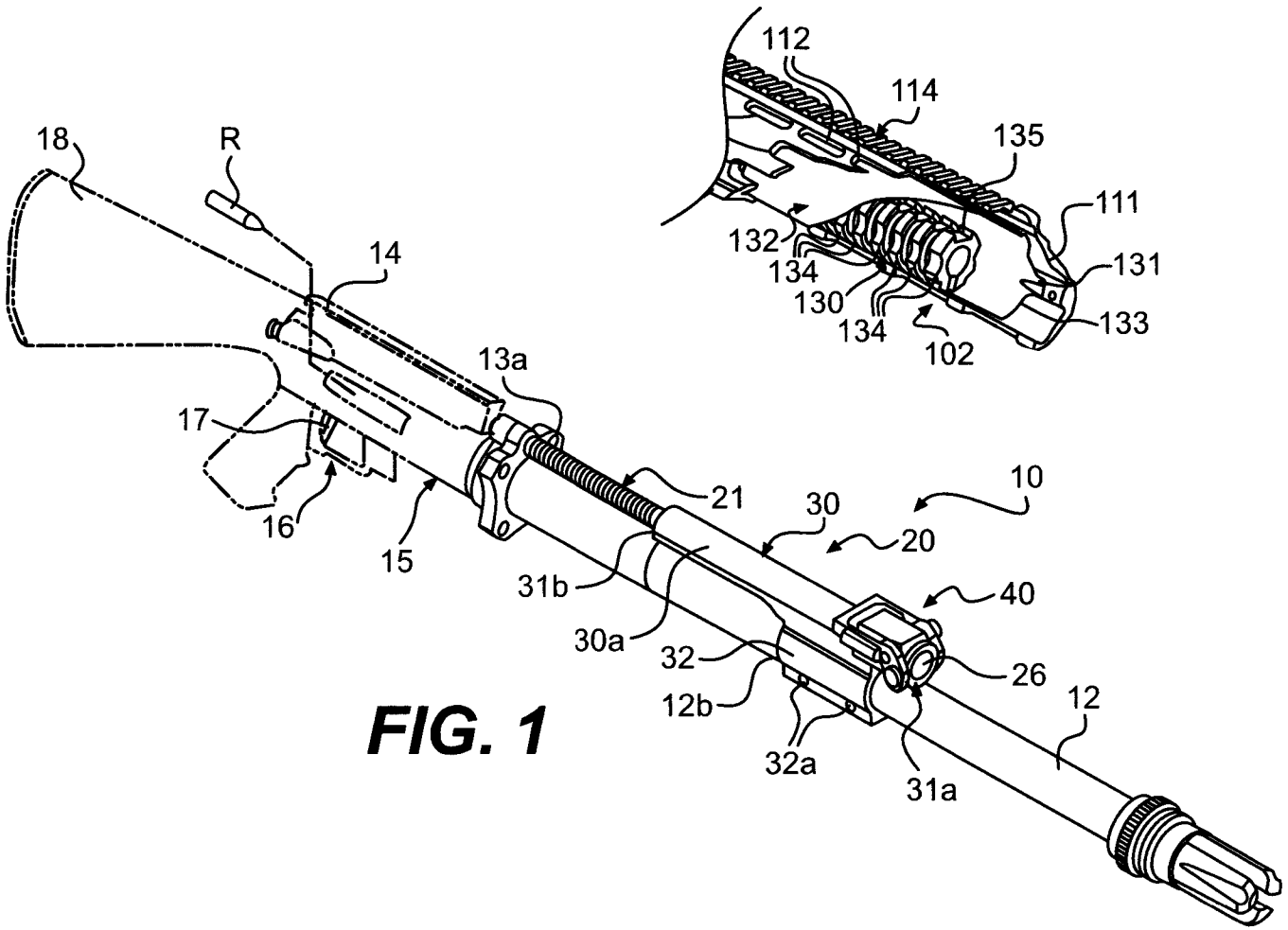
FIG. 1 is an isometric view, with parts broken away for clarity, of a gas-operated firearm with a gas plug retention and removal device, hand guard assembly, and a thermal management system according to an exemplary embodiment of the disclosure.

Referring now to the drawings in which like numerals indicate like parts throughout the several views, the figures illustrate one example embodiment of the gas plug retention and removal apparatus or system according to the principles of the present disclosure for use in a firearm such as an M4, M16, AR-15, SCAR, AK-47, HK416, or similar type gas operated firearm. However, it will be understood that the gas plug retention and removal device can be used in various types of firearms including shotguns and other long guns, hand guns, and other gas-operated firearms. The following description is provided as an enabling teaching of exemplary embodiments; and those skilled in the relevant art will recognize that many changes can be made to the embodiments described. It also will be apparent that some of the desired benefits of the embodiments described can be obtained by selecting some of the features of the embodiments without utilizing other features. Accordingly, those skilled in the art will recognize that many modifications and adaptations to the embodiments described are possible and may even be desirable in certain circumstances, and are a part of the invention. Thus, the following description is provided as illustrative of the principles of the embodiments and not in limitation thereof, since the scope of the invention is defined by the claims.

FIG. 1 illustrates a gas-operated firearm 10 showing a gas operating system with a gas plug retention and removal device in one exemplary embodiment. The firearm 10 generally is shown as a rifle, with parts broken away for clarity, and includes a barrel 12, a receiver 14, a fire control 16, a stock 18, and a gas operating system 20 with a gas block 30 and a gas plug retention and removal device 40. Further, a hand guard assembly 100 and a thermal management system 102 can be affixed to and/or utilized with the firearm 10. Alternatively, any other type of hand guard can be affixed to and/or utilized with the firearm 10, or a hand guard can be omitted from the firearm. For example, the firearm can incorporate a monolithic upper-style receiver and hand guard, wherein the hand guard is integrally formed with the receiver, or an AR-style two-piece receiver and hand guard. The stock 18, also known as the buttstock or shoulder stock, may be formed in any conventional manner to include cushioning, special curvatures, grips, etc. The receiver 14 houses and includes the firing mechanism or fire control 16, including a trigger 17 for actuating the firearm, a breech bolt or bolt assembly, and a firing pin. The bolt assembly is translatable axially in both forward and rearward directions along the receiver during the firing cycle and generally is located behind and communicates with a chamber portion 15 located at a proximal end of the barrel 12 adjacent or at least partially within the receiver 14. The chamber receives a round of ammunition R, such as a shell or cartridge for firing. As indicated in FIGS. 1 and 2, the barrel 12 generally includes a shoulder 12*a* and a barrel orifice 12*b* and can be connected to the upper receiver 14 by a barrel nut 13*a* and a barrel extension 13*b* in an exemplary embodiment of the invention.

Figure 2:
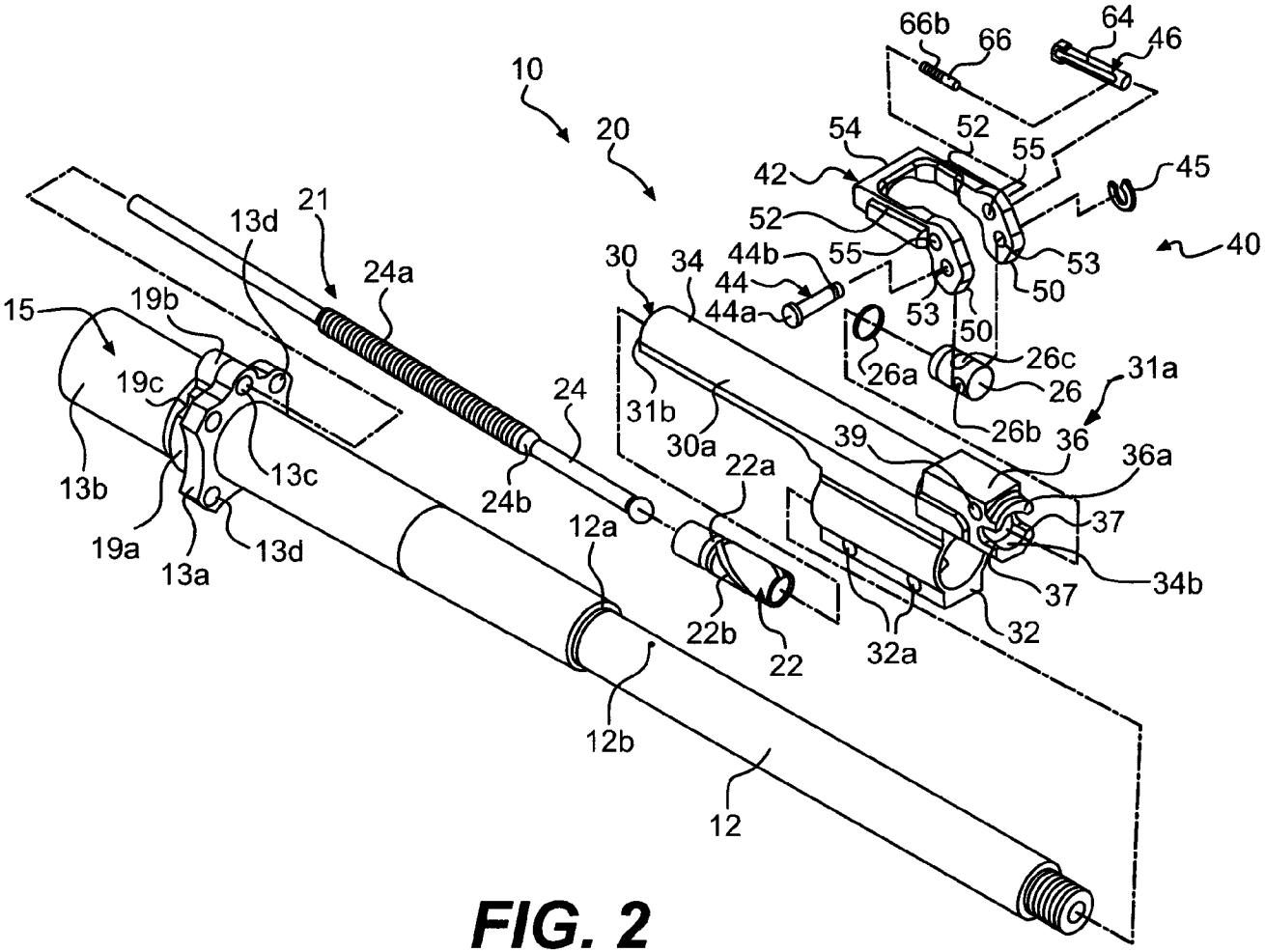
FIG. 2 is an exploded isometric view of the gas plug retention and removal device assembly, the piston assembly, the gas block, and the barrel of FIG. 1.

As shown in FIG. 2, the barrel extension 13*b* can slide axially into a bore in the receiver 14 to interface with the bolt assembly of the firearm 10, and a flange 19*a* of the barrel extension 13*b* can abut the forward wall of the receiver 14. The flange 19*a* of the barrel extension can include a bushing 19*b* for engaging an operating rod or gas impingement tube of the gas operating system 20 and recesses 19*c* generally aligned with threaded bores in the forward wall of the receiver 14. The barrel nut 13*a* can abut the flange 19*a* with clearance holes 13*d* generally aligned with the recesses 19*c* of the barrel extension and threaded bores of the receiver 14 and a clearance bore 13*c* generally aligned with the bushing 19*b* of the barrel extension. The chamber 15 can be contained at least partially within the barrel extension 13*b* inserted into the bore of the receiver 14 so that the chamber can receive a round R from the bolt assembly of the firearm, and the bolt assembly can clear or eject a spent shell or casing. Alternatively, the barrel can be secured to the receiver 14 by any other method and/or apparatus. For example, the barrel 12 can be threaded directly into a bore in the receiver 14. In another example, the barrel 12 can be inserted into a receiver bore that is externally threaded to engage an internally-threaded barrel nut. The internally-threaded barrel nut engages a flange on the barrel as it is tightened onto the external threads of the receiver so as to retain the barrel in the externally-threaded receiver bore.

In the gas-operated semi-automatic firearm 10 illustrated in FIGS. 1 and 2, a gas-operated piston assembly 21 generally can be provided for operation of the firearm for ejecting a spent shell or casing and reloading the chamber after firing by way of mechanical interconnection and interaction between the gas redirecting piston assembly and the bolt assembly of the firearm. During a firing operation, a portion of the expanding combustion gases from the barrel is directed into the gas block 30 of the gas operating system 20, which gas flow accordingly contacts and drives the gas piston rearwardly. This rearward action of the gas piston, which in turn is translated to the bolt, functions to cause a spent cartridge/shell casing to be automatically cleared or ejected from the chamber 15, a new round R to be loaded into the chamber, and the firing pin and bolt to be recocked for a next firing cycle. The gases directed into the gas block 30 generally result from combustion of the primer and propellant powder of the round R upon firing of the round. Combustion byproducts such as carbon, lead, gun powder residue, metal oxides, and other contaminants can be included or entrained within the flow of gases directed into gas block 30. These contaminants can build up in the gas block 30 and on the other components of the gas operating system 20 thereby reducing the effectiveness of the piston assembly 21 by increasing the coefficient of friction between the piston and other gas operating system components, and may have adhesive effects on the components so as to potentially lock components of the gas operating system together to the point of locking and/or preventing proper operation of the firearm.

As shown in FIGS. 1 and 2, the gas operating system 20 includes a gas piston 22, an operating rod 24, and a gas plug 26 adapted to be received within and housed by the gas block 30. The gas block 30 further includes a first, proximal or front end 31*a*, a second, rear or distal end 31*b*, and a barrel clamp 32 adapted to fit and clamp about the barrel 12 to secure the gas operating system thereto, and a gas block bore 34 extending longitudinally therethrough. The barrel clamp 32 engages the barrel 12, abutting the shoulder portion 12*a* thereof so that the barrel orifice 12*b* (FIG. 2) generally aligns with a gas port or inlet 34*a* for the gas block bore 34 (FIG. 5C), which extends through the gas block between the barrel orifice and the gas block bore. The aligned barrel orifice 12*b* and gas port 34*a* enable a portion or flow of combustion gases to communicate from the bore of the barrel 12 into the gas block bore 34.

Figure 5A:
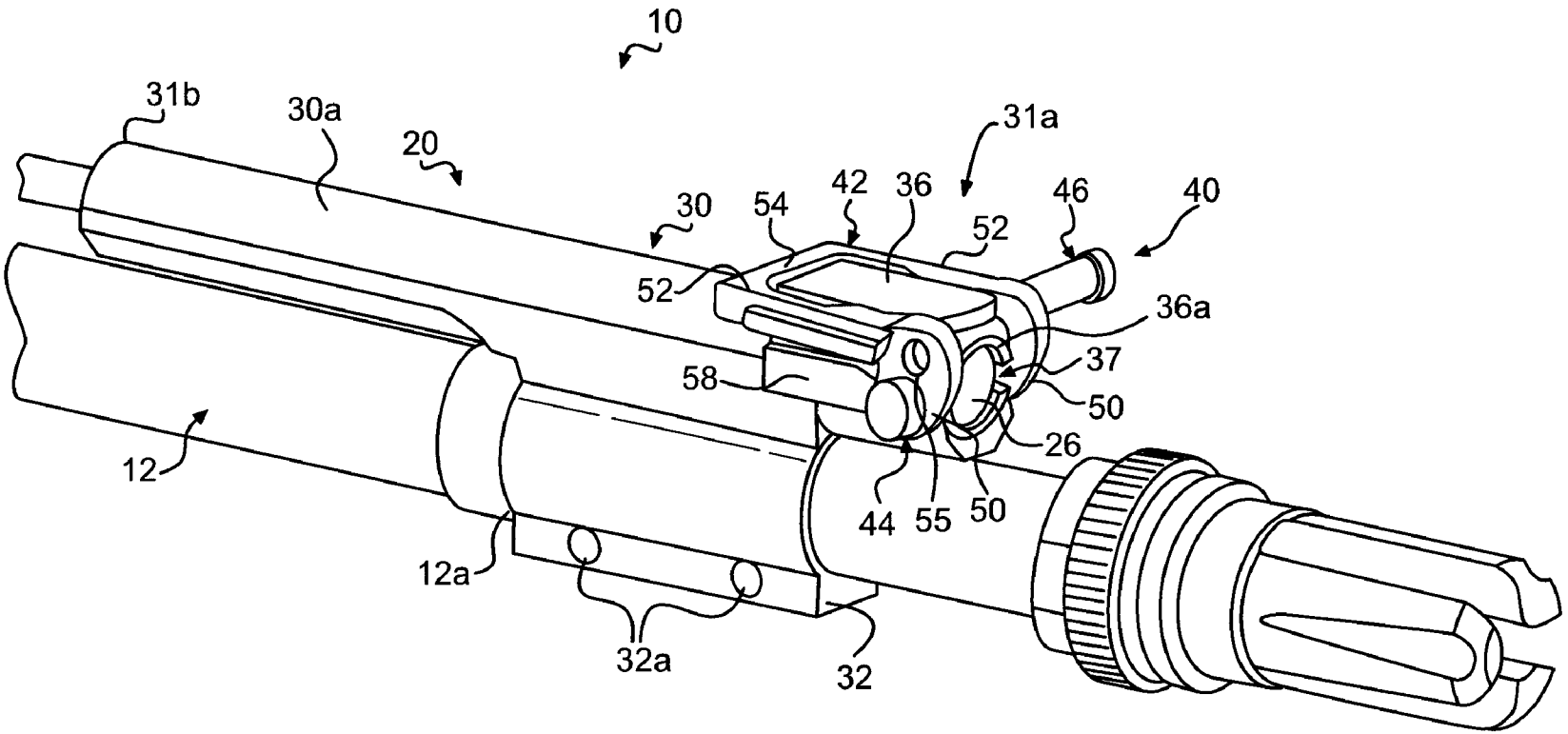
FIG. 5A is an isometric view of the gas plug retention and removal device wherein a cam lever bail is pivoted slightly from a closed position on the gas block.
Figure 5B:
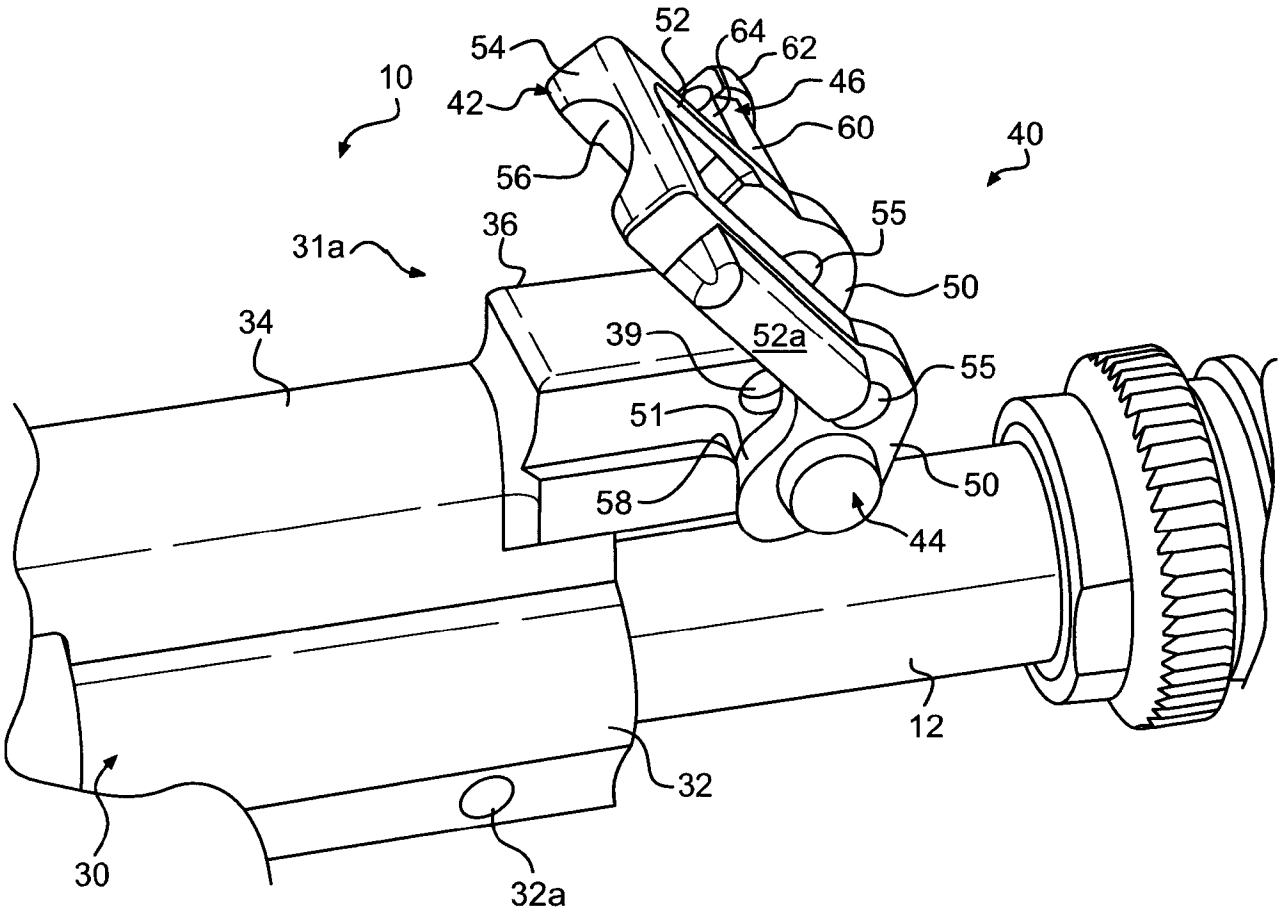
FIG. 5B is an isometric view of the cam lever bail in an upwardly-pivoted position and showing the interaction of the cam lever bail and the forward end of the gas block.
Figure 5C:
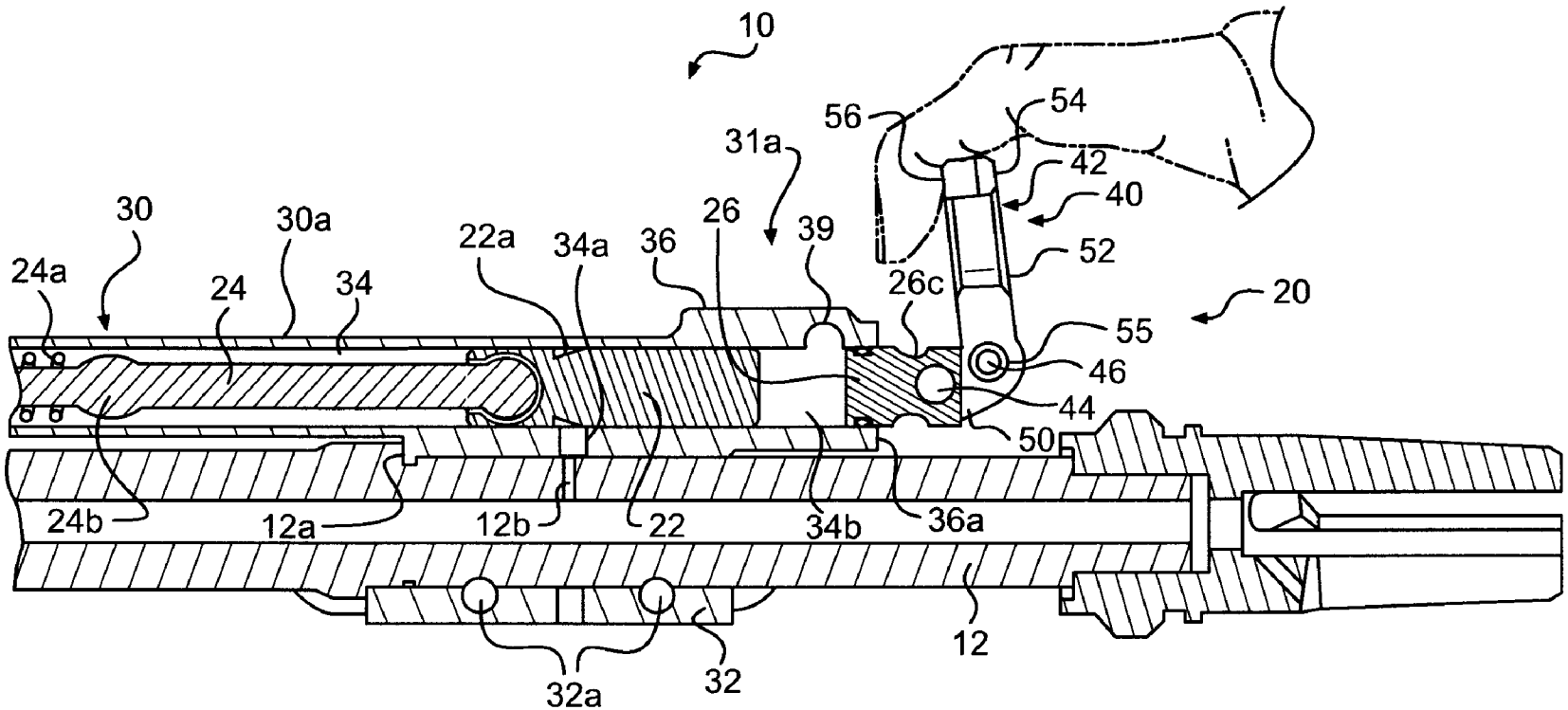
FIG. 5C is a cross-sectional side view of the barrel and gas block showing the unlocked cam lever bail pivoted to a raised, unlocked position with the gas plug being pulled forwardly in the gas block.

As shown in FIGS. 1, 2, and 5C, the operating rod 24 of the firearm's gas operating system 20 is generally located rearwardly of the gas piston in a position aligned with and adapted to be engaged by the gas piston 22 as the gas piston slides along the gas block bore 34 of the gas block housing after firing, with both the operating rod and the gas piston being slideable within the gas block bore and along the gas block for a desired amount of travel. The operating rod 24 (FIGS. 1 and 2) extends beyond the rearward end 31*b* of the gas block bore 34 and through the clearance bore 13*c* of the barrel nut 13*a* and the bushing 19*b* of the barrel extension 13*b* for engaging the bolt assembly in the receiver 14. A piston return spring 24*a* can be concentrically mounted on the operating rod 24, engaging a rod shoulder 24*b* and the barrel nut 13*a* in order to bias the operating rod 24 and the gas piston 22 forwardly. Alternatively or in addition, the gas piston also can be spring biased toward its forward, non-operative position. The gas piston 22 can be biased to a position where a reduced diameter portion 22*a* of the gas piston, or other portion capable of receiving the gases, is generally aligned with the gas port 34*a* so as to enable a passage of gases from the barrel into the gas block bore 34.

As further indicated in FIGS. 2-5C, the gas plug 26 fits within the open first end of the gas block in sealing engagement with the gas block bore 34, and is connected to the gas plug retention and removal device 40. The incoming flow of exhaust or combustion gases can act against the gas plug 26, which is retained in position by the gas plug retention and removal device 40, and can cause the gas piston 22 to move the gas piston rearwardly in the gas block bore 34. Additional details of an exemplary gas piston, an exemplary gas operating system in general, and an exemplary firearm incorporating the same are included in co-pending U.S. patent application Ser. No. 12/818,291, filed Jun. 18, 2010, which application is hereby incorporated by reference for all purposes as if presented herein in its entirety.

Figure 3:
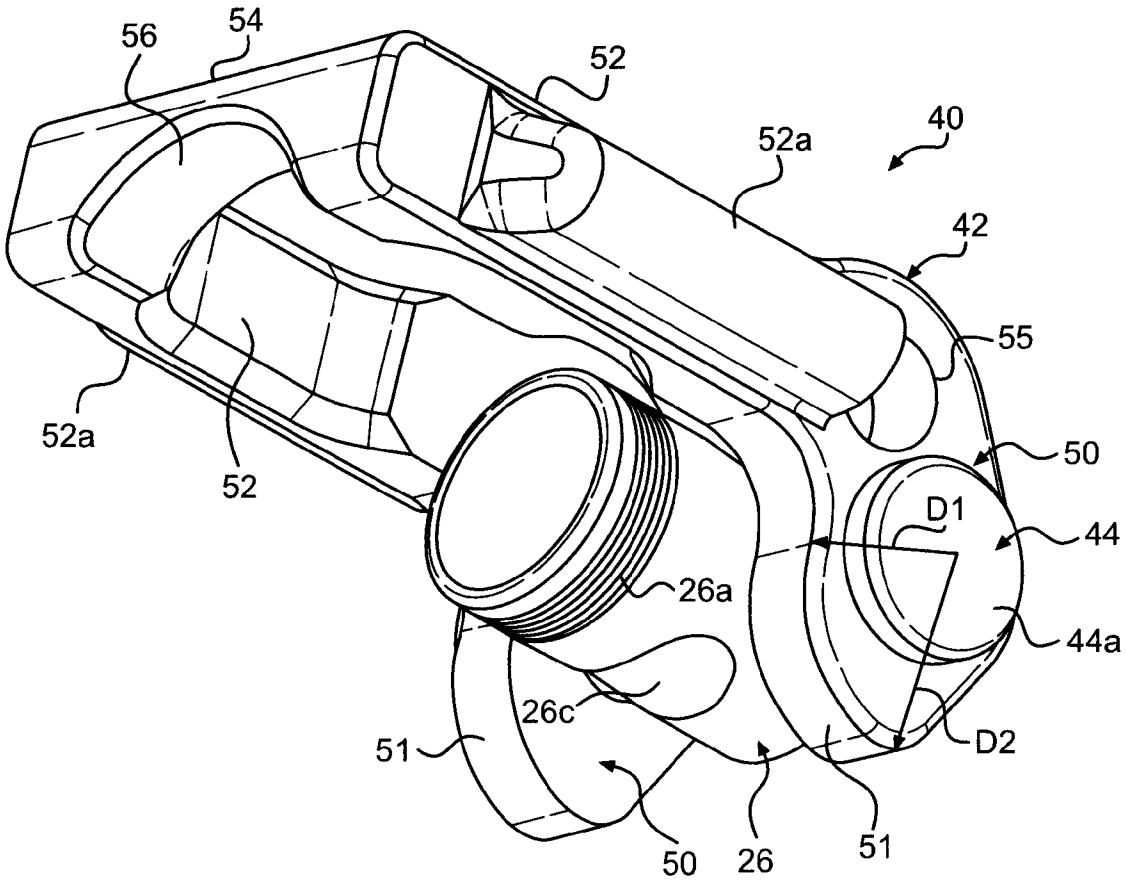
FIG. 3 is an isometric view of the gas plug retention and removal device assembly as viewed from below.
Figure 4:
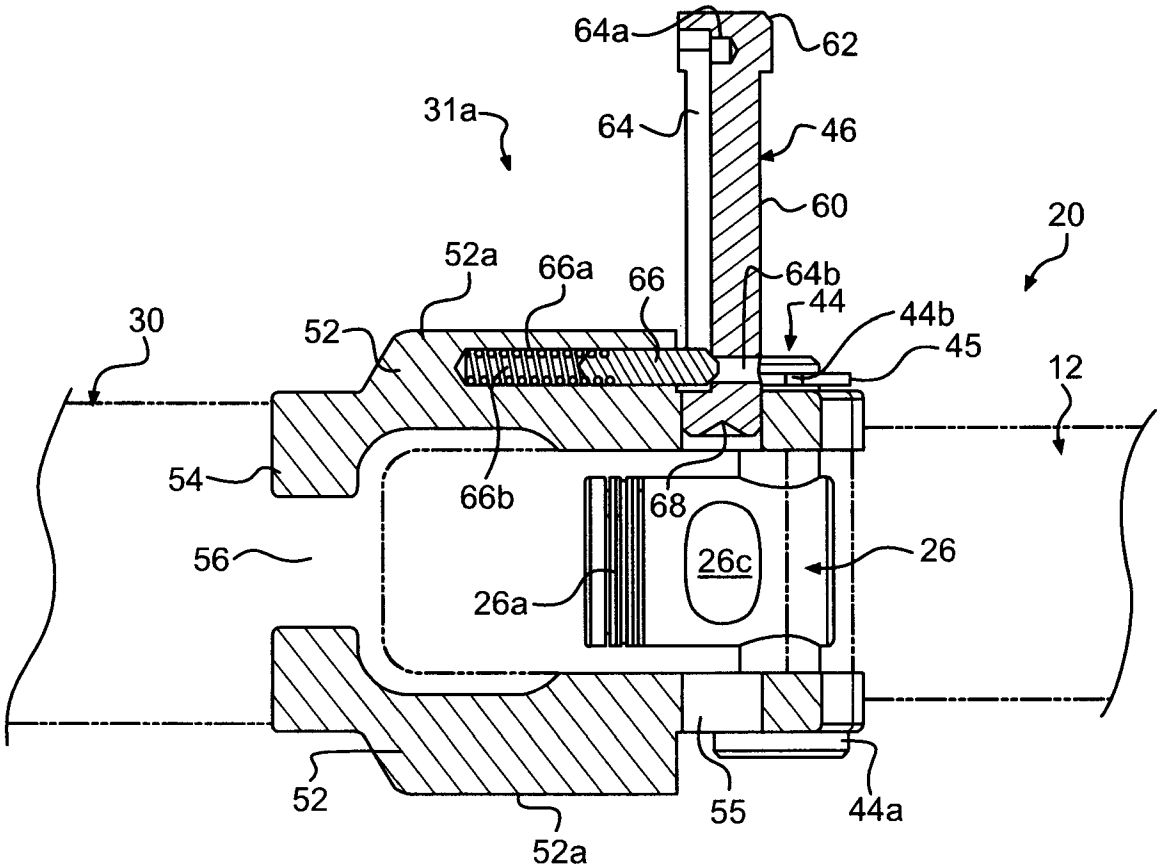
FIG. 4 is a cross-sectional top view of the gas plug retention and removal device assembly of FIG. 3 with the retaining pin in an extended position out of engagement with the cam lever bail.

As illustrated in FIGS. 2, 4, and 5A-5C, the gas block 30 includes an elongated, generally tubular body 30*a*, shown in the present exemplary embodiment as having an enlarged front housing portion 36 at the first end 31*a* of the gas block, the front housing portion including an opening 36*a* at a forward end 34*b* of the gas block bore 34 through which the gas piston 22, operating rod 24, and piston return spring 24*a* can be removed through the open front end 31*a* of the gas block, with the operating rod projecting through the second, open rear end 31 of the gas block adjacent the receiver into engagement with the bolt assembly. As indicated in FIGS. 5A-5C, the gas block bore 34 is defined within the tubular body 30*a* between the front end 31*a* and the rear end 31*b* of the gas block. As shown in FIG. 3, the gas plug 26 includes sealing rings 26*a* that sealingly engage the inner surface of the gas block bore 34 in the front end 31*a* of the gas block bore in order to seal the front end. The sealing rings 26 can include mechanical or other types of seals as will be understood by those skilled in the art, and are adopted to help create a substantially gas-tight sealing engagement between the gas plug and the gas block bore 34 in order to substantially prevent gases in the gas block bore from escaping through the front end 31*a* of the gas block bore. The sealing rings 26*a* can make removal of the gas plug from the gas block bore difficult, however, especially when the aforementioned combustion residue builds up on the gas plug 26.

The gas plug 26 further can include a plug bore 26*b* for engaging the gas plug retention and removal device 40 and one or more plug recesses 26*c*. In the illustrated embodiment, the gas plug 26 also can include two recesses 26*c* (FIG. 5C) so that the gas plug is symmetric so as to facilitate easy coupling of the gas plug to the gas plug retention and removal device 40 without concern for the orientation of the gas plug. Stated another way, the top and bottom of the gas plug 26 can be substantially identical so that the user can couple the gas plug to the gas plug retention and removal device 40 with either the recesses 26*c* of the gas plug directed upwardly and the gas plug 26 will be properly oriented within the forward end 34*b* of the gas block bore when the gas plug retention and removal device 40 is locked onto the front end 31*a* of the gas block, as described in further detail below.

The front end of the gas block can be formed with a one or more recesses 37, a transverse bore 39, and cam engagement surfaces 58 for enabling the cam lever bail 42 of the gas plug retention and removal device 40 to fit against/along the front end of the gas block in a substantially flat-lying, flush, or other low-profile alignment with respect to the front end of the gas block. The recesses 37 and cam engagement surfaces 58 are situated on either side of the front housing portion 36 formed at the front end 31*a* of the gas block so that a first one of the recesses 37 is formed on a first side of the gas block adjacent the peripheral edge of the opening 36*a* formed in front housing portion 36 of the gas block. A second one of the recesses 37 is formed on a second side of the gas block adjacent the peripheral edge of opening 36*a*. As shown in FIG. 4, a first one of the cam engagement surfaces 58 generally extends along the first side of the gas block at the front end 31*a* thereof, while a second one of the cam engagement surfaces 58 generally extends along the second side of the gas block at the front end 31*a* thereof. The transverse bore 39 extends between the sides of the gas block 30 and intersects the gas block bore 34, as shown in FIG. 5C, and can receive a retaining pin 46 for the gas plug retention and removal device 40 when the cam lever bail of the gas plug retention and removal device 40 is in a non-operative and locked orientation or alignment along the front housing portion 36 formed at the front end 31*a* of the gas block 30. As further shown in FIG. 5C, one of the plug recesses 26*c* can be generally aligned with the portion of the transverse bore 39 that intersects the gas block bore 34 to provide clearance for the retaining pin 46 described below.

As shown in FIGS. 2-4, the gas plug retention and removal device 40 includes a cam lever bail 42 is generally coupled to the gas plug 26 by at least one pivot pin 44 or another, similar pivotable connection and is selectively secured to the gas block 30 by a retaining pin 46. As illustrated in further detail in FIG. 3, the cam lever bail 42 is shown in this embodiment with a substantially U- or C-shaped configuration, although other shapes or configurations also can be used, and typically includes one or more cam lobes 50, a pair of spaced lever arms 52, and a crossbar 54 connecting the lever arms. Alternative cam lever bail shapes also can include, for example, a substantially straight or an L-shaped cam lever bail including one cam lobe extending from a single lever arm. In a further alternative, a crossbar can be added to a free end of such a straight or the L-shaped cam lever bail, extending from the end of the lever arm laterally across the gas block to provide a finger grip for the cam lever bail. The crossbar 54 can fit the contour of the outer surface of the front housing portion 36 formed at the front end 31*a* of the gas block 30 and also can include a recess 56 to provide a finger grip (FIG. 5C) for ease of engagement by the user.

As illustrated in the present embodiment shown in FIGS. 5A-5C, each of the lever arms 52 includes a lever arm protrusion 52*a* extending along at least a portion of the length of the lever arm. Each of the lever arm protrusions 52*a* can be configured with a blind bore for receiving a detent pin 66. The detent pin 66 can be configured to engage the retaining pin 46 as described in further detail below. The lever arms 52 also are shown in this embodiment as including pivot pin clearance bores 53 for engaging the pivot pin 44, which extends through the pivot pin clearance bores 53 and the plug bore 26*b* in the gas plug 26 so that the gas plug is pivotally coupled to the cam lever bail 42. The pivot pin 44 can include a cap head 44*a* and a retaining ring 45 that engages a circumferential recess 44*b* in the opposite end of the pivot pin 44. Alternatively, a pair of pivot pins also can be used on opposite sides of the gas block and cam lever bail. When the gas plug 26 is inserted into the front end 31*a* of the gas block, the recesses 37 provide clearance for the pivot pin 44 so that the cam lobes 50 can abut cam engagement surfaces 58 extending from either side of the front end 31*a* of the gas block in a camming engagement/movement when the gas plug 26 is fully inserted into the gas block bore 34.

In the illustrated embodiment, the cam lobes 50 are substantially identical and each extends from a respective lever arm 52 and includes a cam surface 51. The cam lobes 50 can be shaped so that the distance between the cam surface 51 and the axis of the pivot pin 44 gradually increases from distance D1 to distance D2. The cam lobes 50 thus typically will have a cam profile adapted to engage their respective cam engagement surfaces in a manner so as to apply an enhanced longitudinal force on the pivot pin 44 sufficient to disengage and to draw the gas plug 26 out of the gas block bore 34 with a minimal exertion of pulling force by a user. Particularly, as the lever arms 52 are pivoted upwardly about the pivot pin 44, each cam surface 51 pushes against the respective cam engagement surface 58, and the distance between the axis of the pivot pin and the portion of the cam surfaces 51 of the cam lobes in contact with the cam engagement surfaces 58 gradually increases. This increasing contact provides a mechanical advantage that correspondingly increases the force applied to the gas plug 26 by the cam lever bail 42 to dislodge and remove the gas plug 26, while at substantially the same time, the gradually increasing distance necessarily moves the pivot pin 44 forwardly with respect to the gas block 30, and the gas plug 26, which is coupled to the pivot pin 44, is caused to be drawn out of the gas block bore 34. The mechanical advantage provided by the combination of the lever action of the lever arms 52 and the cam profile of the cam lobes 50 helps facilitate the unlocking and/or breaking free of the gas plug from the gas block bore in the case that the sealing rings 26*a* and combustion residue or other contaminants have locked the gas plug in the gas block bore. Further, much of the user's effort applied to the gas plug retention and removal device 40 goes to the longitudinal force that removes the gas plug from the gas block bore. Twisting motions, which may be awkward and inefficient, generally are not necessarily required to unlock the gas plug.

The retaining pin 46 of the gas plug retention and removal device 40 is shown in FIGS. 2 and 4 and is operable to lock the cam lever bail 42 in a non-operative position substantially flush with the front housing portion 36 of the gas block. The retaining pin 46 includes a shaft 60, a head 62, and a pin groove 64. The shaft 60 passes through retainer bores 55 in the cam lever bail 42 and a transverse bore 39 in the front housing portion 36 of the gas block. One of the plug recesses 26*c* typically provides clearance for the retaining pin 46 to pass over the gas plug 26 within the gas block bore 34. The pin groove 64 extends along the shaft 60 and into the head 62 and is adapted to engage the detent pin 66, which is disposed in a blind detent pin bore 66*a* in one of the lever arm protrusions 52*a* of the cam lever bail 42 so as to selectively lock the retaining pin 46 in a retracted or open position or an extended or closed, retaining or locking position. A detent pin spring 66*b* further can be provided for biasing the detent pin 66 into the pin groove 64. The detent pin 66 can engage a bore 64*a* in the head 62 when the retaining pin 46 is in an extended or closed, retaining or locked position (FIG. 1), or a bore 64*b* when the retaining pin 46 is in a retracted or open position (FIG. 4) so as to allow the cam lever bail 42 to pivot about the pivot pin 44 relative to the gas block 30 for removing the gas plug 26. The bore 64*b* can be a thru-bore so that a user can disengage the detent pin 66 from the bore 64*b* by inserting a small pin or other tool into the open end of the bore 64*b* and force the detent pin 66 against the detent pin spring 66*b*.

A proximal or first end 68 of the shaft 60 can be configured with a dimple, indentation, or other seating portion to receive a pointed tool or a readily-available object, such as a bullet therein. When the retaining pin 46 is in the retaining position, a longitudinal force on the retaining pin 46 applied at the dimple 68 causes the detent pin to disengage from bore 64*a* so the retaining pin 46 can slide to the open position until the detent pin 66 engages the bore 64*b*. The detent pin 66 also can have a frustoconical end so that the longitudinal force causes the edge of the bore 64*a* to act on a slanted surface at the end of the detent pin 66 so that a portion of the longitudinal force causes the detent pin 66 to translate out of the bore 64*a* in a generally transverse direction. The bore 64*b* thereby can be configured to retain the retaining pin 46 in the open position until a user actuates the detent pin 66 to either fully remove the retaining pin 46, or return it to the locked position. Therefore, the retaining pin 46 does not need to be removed from the gas plug retention and removal device 40 when removing the gas plug 26 from the gas block 30, and the risk of loosing the retaining pin 46 is reduced.

As shown in FIG. 4, the detent pin bore 66*a* can be formed in either or both of the lever arms 52 as desired. In an alternative embodiment where the detent pin bore 66*a* is located in both lever arms 52, the user has a choice of situating the detent pin spring 66*b* and the detent pin 66 in one lever arm or the other or both so that the retaining pin 46 can be oriented as shown in the figures, oppositely to that shown in the figures. In a further alternative, a detent pin 66 and detent pin spring 66*b* can be positioned within a detent pin bore 66*a* located along each lever arm 52 so that multiple detent pins 66 can be provided to engage respective bores 64*a*, 64*b* in the retaining pin 46 and thus secure the retaining pin 46, and thus the cam lever bail 42, in a fixed, non-operative position to prevent accidental engagement of the cam lever bail 42 and dislocation of the gas plug 26. In another alternative embodiment, the retaining pin 46 can include only one of the bores 64*a*, 64*b* for being retained in either the open or closed position by the detent pin 66.

When locked to the front end 36 of the gas block 30 as shown in FIG. 1, the gas plug retention and removal device 40 retains the gas plug 26 within the front end 31*a* of the gas block 30 and the cam lever bail thereof generally is oriented or aligned with the front housing portion 36 formed at the first or front end of the gas block so as to provide a flat-lying or low profile appearance to minimize potential unintended engagement with the cam lever bail and/or disruption of lines of sight along the firearm. The gas plug retention and removal device 40 aids in the removal of the gas plug 26 when desired, such as for cleaning the gas block bore 34 and piston assembly 21 or gas impingement tube 21' described below. The removal of the gas plug 26 is shown in FIGS. 5A-5C, and includes operating the retaining pin 46 to move it to the open position shown in FIG. 5A and pivoting the cam lever bail 42 about the pivot pin 44 as the cam lobes 50 act on the cam engagement surfaces 58. Pivoting the lever arms 52 about the pivot pin 44 and the action of the cam lobes 50 on the surfaces 58 provide a mechanical advantage for drawing the gas plug 26 out of the gas block bore 34, wherein the gas plug can become locked into the gas block bore due to carbon build-up, dirt, or corrosion as a result of use of the firearm. As the lever arms 52 are pivoted upwardly about the pivot pin 44, each cam surface 51 pushes against the respective cam engagement surface 58, and the distance between the axis of the pivot pin and the portion of the cam surfaces 51 of the cam lobes in contact with the cam engagement surfaces 58 gradually increases causing the cam lobes to increasingly bear on the cam engagement surfaces. This increasing contact provides a mechanical advantage that correspondingly increases the force applied to the gas plug 26 by the cam lever bail 42 to dislodge and remove the gas plug 26, while at substantially the same time, the gradually increasing distance necessarily moves the pivot pin 44 forwardly with respect to the gas block 30, and the gas plug 26, which is coupled to the pivot pin 44, is caused to be drawn out of the gas block bore 34 to enable external access to the gas block bore and operative components of the gas operating system 20.

Particularly, with the retaining pin 46 in its extended, locked or closed position shown in FIG. 1, a tool, bullet, or other available object can be used to engage the proximal or first end 68 of the retaining pin 46, which, as noted, can be formed with a dimple or seat to facilitate this engagement, to apply a longitudinal force to the retaining pin 46 to urge the retaining pin 46 laterally across the gas block 30 and cam lever bail 42. The longitudinal force exerted by movement of the retaining pin 46 out of the retainer bore 55 and across the gas block 30 further causes the edge of the bore 64*a* to act on the frustoconical end of the detent pin 66 so that the detent pin 66 translates rearwardly along its detent pin bore 66*a* in the lever arm 52 against the force of the detent pin spring 66*b*, releasing the detent pin 66 from its locked engagement with the retaining pin 46. As the retaining pin 46 begins to translate toward a retracted or open position shown in FIG. 5A, the pin groove 64 of the retaining pin 46 slides over the detent pin 66. The user then can pull the retaining pin 46 until it is withdrawn from the transverse bore 39 in the front end 31*a* of the gas block bore and the detent pin 66 engages the bore 64*b*. The cam lever bail 42 can now pivot about the pivot pin 44.

To pivot the cam lever bail 42 and remove the gas plug 26, the user can grasp the crossbar 54, such as with a finger, and pivot the cam lever bail 42 about the pivot pin 44, as shown in FIGS. 5B and 5C. As the cam lever bail 42 pivots, the cam surfaces 51 of the cam lobes 50 slide against the respective cam engagement surfaces 58 on either side of the front end 36 of the gas block. The cam lever bail 42 acts as a lever providing a mechanical advantage to the user and applying a forwardly-directed force on the gas plug 26 via the pivot pin 44. This mechanical advantage generally helps break free the gas plug in the event that the gas plug is locked into the gas block bore with minimal pulling effort required from the user.

As the portion of the surface 51 on each cam lobe 50 in contact with the respective cam engagement surface 58 moves from the D1 distance to the D2 distance from the axis of the pivot pin 44, the cam lobes 50 bear and push against the surfaces 58 to draw the gas plug 26 farther out of the front end 36 of the gas block bore as the camming engagement further overcomes any sealing force between the gas plug 26 and the opening in the gas block 30. After the user pivots the cam lever bail 42 to the point where the portion of the surface 51 is in contact with the surface 58 is the D2 distance from the axis of the pivot pin 44, the cam lobe profiles decrease in size so the user can easily pivot the cam lever bail 42 relatively freely about the pivot pin 44 as needed until the cam lever bail is at a comfortable angle for the user to pull on the cam lever bail and remove the remaining portion of the gas plug 26 from the gas block bore 34 at the front end 31*a* of the gas block.

With the gas plug 26 removed from the gas block bore 34, the operative components of the gas operating system 20 of the firearm, including the piston assembly 21 and gas piston 22, the operating rod 24, and the piston return spring 24*a*, can be accessed externally and can be removed from the front end 31*a* of the gas block 30 for cleaning, repair, and/or replacement as needed. The gas block bore 34 can then be cleaned and the piston assembly 21 replaced. Alternatively, the piston assembly 21 can be replaced by a different piston assembly. For example, the piston return spring 24*a* can be replaced with a piston return spring having a higher or lower spring constant or compression force.

With the piston assembly 21, or an alternative piston assembly, repositioned within the gas operating system 20, as shown in FIG. 1, the gas plug 26 can be replaced within the opening 36*a* of the gas block bore. The gas plug is aligned with the open end of the gas block bore 34, and the cam lever bail 42 is aligned so that the pivot pin 44 is slidable within the recesses 37. The user pushes the gas plug 26 into the opening 36*a* and pivots the cam lever bail 42 until the recess 56 in the crossbar 54 engages a top surface of the gas block 30 adjacent a rear edge of the front housing portion 36. The retainer bores 55, the transverse bore 39, and the plug recess 26*c* are then aligned and the retaining pin 46 can be operated to be moved to the locked position shown in FIG. 1. Particularly, the user can insert a small pin or other tool into the bore 64*b* and force the detent pin 66 against the detent pin spring 66*b*. The user can then push the retaining pin 46 in through the bores 55, 39 with the detent pin 66 sliding in the pin groove 64 until the detent pin engages the bore 64*a* in the head 62 of the retaining pin 46. In this locked position of the retaining pin 46, the cam lever bail of the gas plug retention and removal device 40 is locked in a substantially flat-lying, flush mounted arrangement with respect to the front housing portion 36 formed at the front end 31*a* of the gas block 30 as shown in FIG. 1 and retains the gas plug 26 within the front end 31*a* of the gas block 30.

Figure 5D:
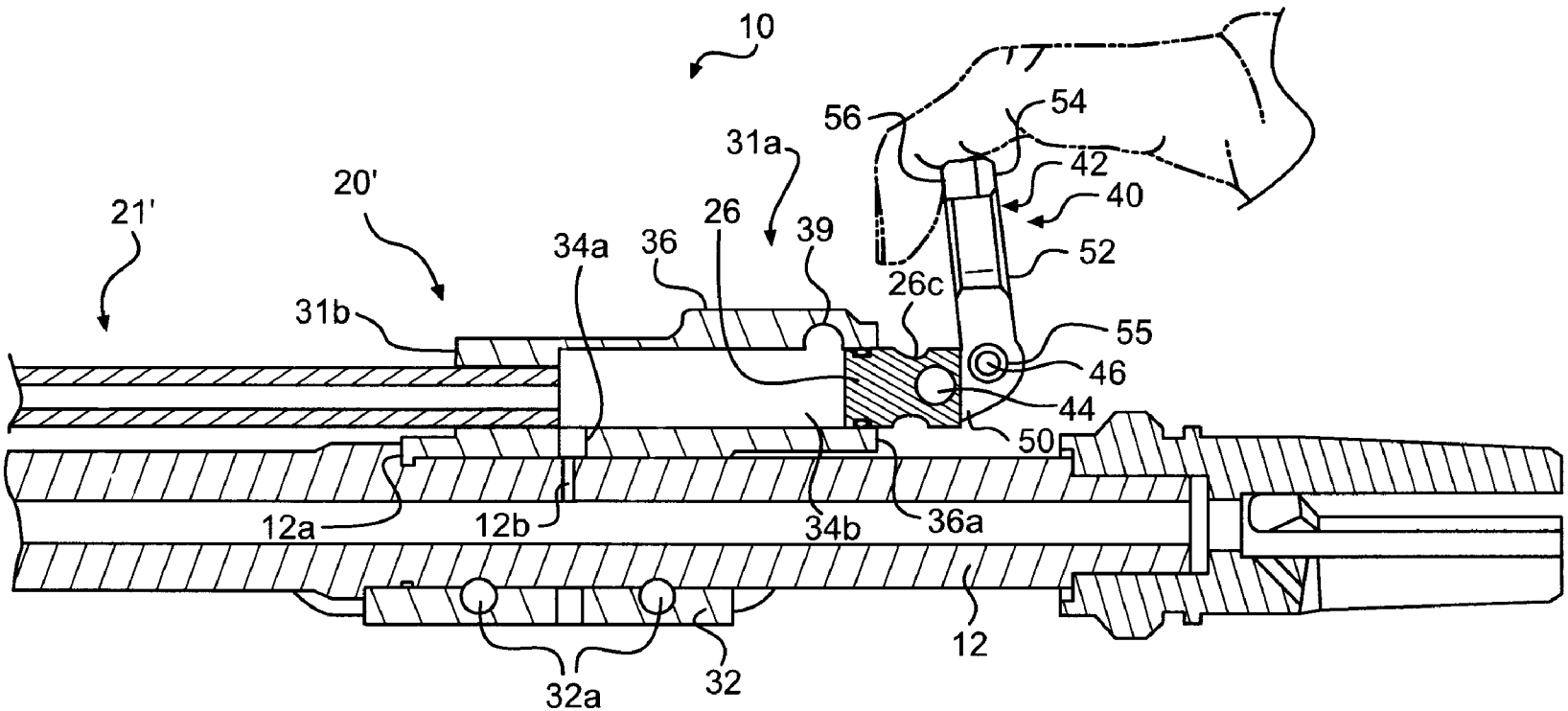
FIG. 5D is a cross-sectional side view of the barrel and gas block with an alternative gas impingement operating system showing the unlocked cam lever bail pivoted to a raised, unlocked position with the gas plug being pulled forwardly in the gas block.

It should be noted that the firearm 10 generally can include a gas impingement operating system instead of the piston-type gas operating system without affecting the operation of the gas plug 26 and the gas plug retention and removal device 40. As illustrated in FIG. 5D, the firearm 10 generally can include a gas operating system 20' with a gas impingement tube 21' for operation of the firearm for ejecting a spent shell or casing and reloading the chamber after firing by way of redirection of the expanding combustion gas flow to the bolt assembly of the firearm. During a firing operation, a portion of the expanding combustion gases from the barrel is directed into the gas block 30, which gas flow accordingly is directed rearwardly into the gas impingement tube 21', which terminates at the gas key of the bolt carrier. This rearward gas flow, which applies a rearward pressure on the bolt carrier, functions to cause a spent cartridge/shell casing to be automatically cleared or ejected from the chamber 15, a new round R to be loaded into the chamber, and the firing pin and bolt to be recocked for a next firing cycle.

As illustrated in FIG. 5D, the gas impingement tube 21' is positioned within the gas block bore 34 and extends beyond the rearward end 31*b* of the gas block bore and into the receiver 14 to the bolt carrier. The gas impingement tube 21' includes a flange providing a generally sealing engagement with the gas block bore 34 so that the gas flow entering the gas block bore from the barrel 12 through the barrel orifice 12*b* and the gas port 34*a* can act against the gas plug 26, which is retained in position by the gas plug retention and removal device 40, and can flow into the gas impingement tube. The gas flow exiting the rearward end of the gas impingement tube 21' generally impinges on the bolt.

With the gas plug 26 removed as described above, the gas impingement tube 21' and the gas block bore 34 can be accessed externally for cleaning, repair, replacement, or other servicing. After servicing the gas block bore and gas impingement tube, the gas plug 26 is replaced within the opening 36*a* of the gas block bore as described above.

Figure 6:
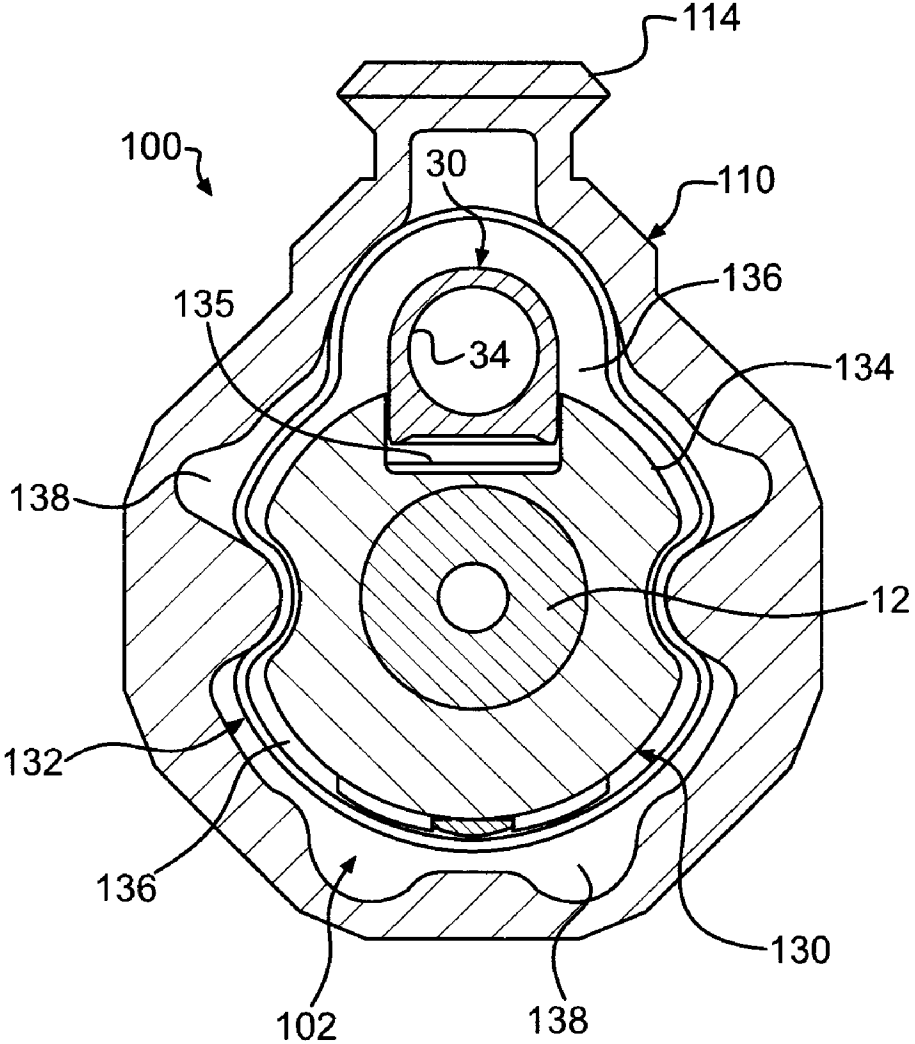
FIG. 6 is an end cross-sectional view of the hand guard and thermal management system according to an exemplary embodiment of the disclosure.

An optional hand guard assembly 100 and the thermal management system 102 are generally shown in FIGS. 1 and 6 and can be affixed to the fore-end of the firearm 10 along the barrel 12 as needed or desired. According to the example embodiment shown in FIGS. 1 and 6, the hand guard assembly includes a vented hand guard 110 and the thermal management system 102. The hand guard 110 includes vent holes 112 and optional accessory rails 114.

According to one embodiment of the disclosure, the thermal management system 102 will be mounted along the barrel 12, located between the barrel and the hand guard 110 as indicated in FIGS. 1 and 6, and includes a heat exchanger or radiator 130 and a heat shield 132. The radiator 130 is a heat-conducting structure that can be secured to the barrel 12 such as with a close slip or light press fit engagement with the barrel. Alternatively, the radiator can be formed from two or more pieces clamped along the barrel. Adhesives or other fasteners also can be used to secure the radiator to the barrel. In addition, the radiator 130 can be secured to the gas block 30. The radiator 130 can be steel, aluminum, or any other heat-conducting material, and can include ribs or fins 134 to help dissipate heat therefrom. The ribs 134 are shown in FIG. 1 as being circumferential ribs; however, the ribs can be longitudinal, helical, or otherwise oriented. One or more longitudinal recesses 135 (FIGS. 1 and 6) can be included in the radiator 130 to provide clearance for the gas block 30 and operating rod 24. The longitudinal recesses 135 can also promote air flow between the ribs 134. Alternatively, the radiator 130 can be integral with the barrel 12, and longitudinal, spiral, or circumferential flutes can be formed in the barrel.

The heat shield 132 can be formed by a continuous sheet or woven fabric of a thermally resistant material, such as certain metals, carbon fiber, or other synthetic or composite materials. The heat shield 132 can be attached to the inner surface of the hand guard 110 with tabs 131 secured by adhesive, mechanical fasteners, or another fastening method on either side of the muzzle end 111 of the hand guard 110. Additional tabs (not shown) of the heat shield can be secured to the rear portion of the fore end 116 of the hand guard. A thermal barrier coating also can be applied to the inside of the heat shield 132, the hand guard 110, or both. In one example embodiment, the heat shield 132 can form a continuous sleeve around the barrel 12, as shown in the cross-section of FIG. 6, and can have an open end 133 located near the muzzle end 111 of the hand guard 110 for evacuating the heat from around the barrel 12 while also directing the heat away from the user and the hand guard 110. The heat shield can be tapered so that a larger open end 133 of the heat shield is located near the muzzle end 111 of the hand guard 110. The tapered heat shield 132 further encourages heat from around the barrel 12 to evacuate through the muzzle end 111 of the hand guard 110.

According to an embodiment of the invention such as shown in FIG. 6, the heat shield 132 can form an inner annular volume 136 and an outer annular volume 138. The inner annular volume 136 is formed between the heat shield 132 and the barrel 12 or radiator 130 and extends at least partially around the barrel to form one or more air pockets between the barrel or radiator and the heat shield. Similarly, the outer annular volume 138 is formed between the heat shield 132 and the hand guard 110 and extends at least partially around the barrel 12 to form one or more air pockets between the heat shield and the hand guard. The heat shield 132 and inner and outer annular volumes 136, 138 cooperate to isolate the hand guard 110 from the heat of the barrel 12.

It therefore can be seen that the construction of the gas-operated firearm with a gas plug retention and removal device and thermal management system according to the principles of the present disclosure provides a firearm with a cam lever bail for providing mechanical advantage for removing the gas plug from the gas block. Thus, the gas plug retention and removal device facilitates a user's easy access to the gas block bore and piston assembly. The thermal management system isolates the hand guard from the heat of the barrel to protect the user while allowing the heat to dissipate away from the barrel.

The corresponding structures, materials, acts, and equivalents of all means plus function elements in any claims below are intended to include any structure, material, or acts for performing the function in combination with other claim elements as specifically claimed.

Those skilled in the art will appreciate that many modifications to the exemplary embodiments are possible without departing from the scope of the invention. In addition, it is possible to use some of the features of the embodiments described without the corresponding use of the other features. Accordingly, the foregoing description of the exemplary embodiments is provided for the purpose of illustrating the principle of the invention, and not in limitation thereof, since the scope of the invention is defined solely be the appended claims.

What is claimed is:

1. A gas plug retention and removal device for a gas operating system of a firearm, comprising:

a gas block including a front end, a rear end, a gas block bore defined between the front and rear ends, and at least one cam engagement surface adjacent the front end;

a gas plug removably received within an opening in the front end of the gas block and communicating with the gas block bore for at least partially sealing the gas block bore; and a cam lever bail coupled to the gas plug and including at least one lever arm pivotally connected to the gas plug and adapted to engage the gas block and having at least one cam lobe formed therealong, the at least one cam lobe engaging the cam engagement surface of the gas block as the cam lever bail is pivoted with respect to the gas block so as to facilitate disengagement and removal of the gas plug from the gas block and provide external access to the gas block bore.

2. The gas plug retention and removal device of claim 1, wherein the at least one cam engagement surface comprises a first cam engagement surface extending on a first side of the gas block and a second cam engagement surface extending on a second side of the gas block.

3. The gas plug retention and removal device of claim 2, wherein the at least one lever arm comprises a first lever arm with a first cam lobe formed adjacent one end thereof and a second lever arm with a second cam lobe formed adjacent one end thereof, the first cam lobe being situated on the first side of the gas block and the second cam lobe being situated on the second side of the gas block.

4. The gas plug retention and removal device of claim 3, wherein the first and second lever arms are connected by a crossbar having a finger recess therealong.

5. The gas plug retention and removal device of claim 3, wherein each of the first and second lever arms defines a pivot pin clearance bore, and the gas plug defines a plug bore that is generally aligned with the pivot pin clearance bores, and further comprising a pivot pin extending through the pivot pin clearance bores and the plug bore to pivotally couple the cam lever bail to the gas plug.

6. The gas plug retention and removal device of claim 5, wherein the gas block bore defines an opening at the front end of the gas block, and the gas block further comprises a first recess and a second recess, each formed at an edge of the opening of the gas block bore, the pivot pin being received within at least one of the first and second recesses.

7. The gas plug retention and removal device of claim 5, wherein the cam lever bail comprises a first retainer bore in the first lever arm and a second retainer bore in the second lever arm, and the gas block comprises a transverse bore that is generally aligned with the first and second retainer bores when the cam lever bail is in a locked position.

8. The gas plug retention and removal device of claim 7, further comprising a retaining pin extending through at least one of the first and second retainer bores defined in at least one lower arm of the cam lever bail and selectively engaging a transverse bore in the gas block for selectively securing the cam lever bail in a non-operative position with respect to the gas block, and a detent pin at least partially extending in a detent pin bore defined in the at least one lever arm, wherein the detent pin is biased toward engagement with the retaining pin for locking the retaining pin in at least one position.

9. The gas plug retention and removal device of claim 8, wherein the gas plug further comprises a plug recess generally aligned with a portion of the transverse bore intersecting the gas block bore and providing clearance for the retaining pin.

10. The gas plug retention and removal device of claim 1, further comprising a retaining pin adapted to selectively lock the cam lever bail to the gas block in a non-operative position.

11. The gas plug retention and removal device of claim 10, wherein the gas block comprises a front housing portion at the front end of the gas block, the front housing portion defining an opening through which the gas plug is received, and wherein the cam lever bail further comprises a retainer bore in the at least one lever arm, the retaining pin extending along at least the retainer bore.

12. The gas plug retention and removal device of claim 11, further comprising a detent pin extending in a direction generally normal to the retaining pin along a detent pin bore defined in the at least one lever arm, wherein the detent pin is adapted to selectively engage a first bore defined by the retaining pin so as to lock the retaining pin in at least one of an extended position and a retracted position, the retaining pin extending through the retainer bore and into the opening through the front housing portion in its extended position, locking the cam lever bail to the gas block in the non-operative position.

13. The gas plug retention and removal device of claim 12, wherein the detent pin engages the first bore when the retaining pin is in the extended position, and the retaining pin comprises a second bore adapted to receive at least a portion of the detent pin when the retaining pin is in its retracted position so as to lock the retaining pin in the retracted position, the first and second bores being adjacent respective opposing ends of the retaining pin.

14. The gas plug retention and removal device of claim 11, wherein the cam lever bail is substantially flush with the front housing portion of the gas block when locked in the non-operative position.

15. A firearm, comprising:

a barrel defining a chamber;

a gas block extending at least partially along the barrel and including a gas block bore defining an opening at a front end thereof, at least one cam engagement surface adjacent a first end of the gas block, and a barrel clamp engaging the barrel;

a gas plug removably engaged within the opening at the front end of the gas block bore for at least partially sealing the gas block bore; and a cam lever bail pivotally coupled to the gas plug and including at least one cam lever arm having at least one cam lobe, the at least one cam lobe aligned with and adapted to engage the at least one cam engagement surface of the gas block, whereby as the cam lever bail is pivoted, the at least one cam lever arm provides a cammed lever action and the at least one cam lobe increasingly bears against the at least one cam engagement surface so as to provide a mechanical advantage facilitating disengagement and removal of the gas plug from the gas block.

16. The firearm of claim 15, further comprising a retaining pin adapted to selectively lock the cam lever bail to the gas block in a non-operative position.

17. The firearm of claim 16, wherein the gas block comprises a front housing portion at the first end of the gas block, the front housing portion defining an opening through which the gas plug is received, and wherein the cam lever bail further comprises a retainer bore in the at least one lever arm, the retaining pin extending along at least the retainer bore.

18. The firearm of claim 17, further comprising a detent pin extending in a direction generally normal to the retaining pin along a detent pin bore defined in the at least one lever arm, wherein the detent pin is adapted to selectively engage a first bore defined by the retaining pin so as to lock the retaining pin in at least one of an extended position and a retracted position, the retaining pin extending through the retainer bore and into the opening through the front housing portion in its extended position, locking the cam lever bail to the gas block in the non-operative position.

19. The firearm of claim 17, wherein the cam lever bail is substantially flush with the front housing portion of the gas block when locked in the non-operative position.

20. The firearm of claim 15, wherein the at least one cam engagement surface comprises a first cam engagement surface extending on a first side of the gas block and a second cam engagement surface extending on a second side of the gas block.

21. The firearm of claim 20, wherein the at least one lever arm comprises a first lever arm with a first cam lobe formed adjacent one end thereof and a second lever arm with a second cam lobe formed adjacent one end thereof, the first cam lobe being situated on the first side of the gas block and the second cam lobe being situated on the second side of the gas block.

22. The firearm of claim 21, wherein each of the first and second lever arms defines a pivot pin clearance bore, and the gas plug defines a plug bore that is generally aligned with the pivot pin clearance bores, and further comprising a pivot pin extending through the pivot pin clearance bores and the plug bore to pivotally couple the cam lever bail to the gas plug.

23. The firearm of claim 15, further comprising a thermal management system extending at least partially about the barrel.

24. The firearm of claim 23, wherein the thermal management system comprises a heat exchanger extending at least partially along the barrel and a heat shield extending at least partially along the heat exchanger.

25. The firearm of claim 24, wherein the heat exchanger comprises a heat-conducting structure with a plurality of fins extending therealong, and the heat shield comprises a substantially continuous sleeve of thermally resistant material extending around the barrel with an open end adjacent a muzzle end of the barrel.

26. The firearm of claim 25, wherein the heat shield comprises a woven fabric comprising carbon fiber.

27. The firearm of claim 24, further comprising a hand guard at least partially extending along the barrel and at least partially extending around the heat shield, wherein at least a portion of the heat shield is radially spaced apart from the heat exchanger with at least one inner air pocket formed therein, and at least a portion of the hand guard is radially spaced apart from the heat shield with at least one outer air pocket formed therein.

* * * * *